US008453590B1

(12) United States Patent
Pittman et al.

(10) Patent No.: US 8,453,590 B1
(45) **Date of Patent: *Jun. 4, 2013**

(54) MOORING SYSTEMS AND METHODS

(75) Inventors: John Robert Pittman, Springfield, VA (US); Robert Charles Truston, Yorktown, VA (US); Matthew Marcy, Annapolis, MD (US); Erick Knezek, Lafayette, LA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/306,334

(22) Filed: Nov. 29, 2011

Related U.S. Application Data

(62) Division of application No. 13/305,893, filed on Nov. 29, 2011.

(51) Int. Cl.
*B63B 21/00* (2006.01)

(52) U.S. Cl.
USPC ..... 114/230.24

(58) Field of Classification Search
USPC ..... 114/230.1, 230.2, 230.22, 230.24, 114/230.25, 230.26, 230.27
See application file for complete search history.

(56) References Cited

U.S. PATENT DOCUMENTS

| | | | | |
|---|---|---|---|---|
| 2,440,972 | A * | 5/1948 | Peltier | 114/230.19 |
| 3,060,884 | A * | 10/1962 | Wood | 114/230.24 |
| 5,265,553 | A * | 11/1993 | Brydges | 114/230.22 |
| 5,341,757 | A * | 8/1994 | Digiacomo | 114/230.27 |
| 6,227,136 | B1 * | 5/2001 | Shapiro | 114/230.2 |

OTHER PUBLICATIONS

J.R. Pittman and Greg Kemp, Design Analysis for CV Mooring, Site Specific Report, May 1996.
Unknown author, Design Manual, Harbor and Coast Facilities, NAVFAC-DM 26, Jul. 1968.

* cited by examiner

*Primary Examiner* — Daniel Venne
(74) *Attorney, Agent, or Firm* — Christopher L. Blackburn

(57) ABSTRACT

Self-tensioning load-equalizing mooring systems and methods (of mooring a ship) that employ at least one mooring line and at least one counter-weight.

18 Claims, 5 Drawing Sheets

MOORING SYSTEMS AND METHODS

CROSS-REFERENCE TO RELATED APPLICATIONS

This is a divisional application, claiming the benefit of parent application Ser. No. 13/305,893 filed on Nov. 29, 2011, whereby the entire disclosure of which is incorporated hereby reference.

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The invention generally relates to mooring systems and methods.

Figure 1:
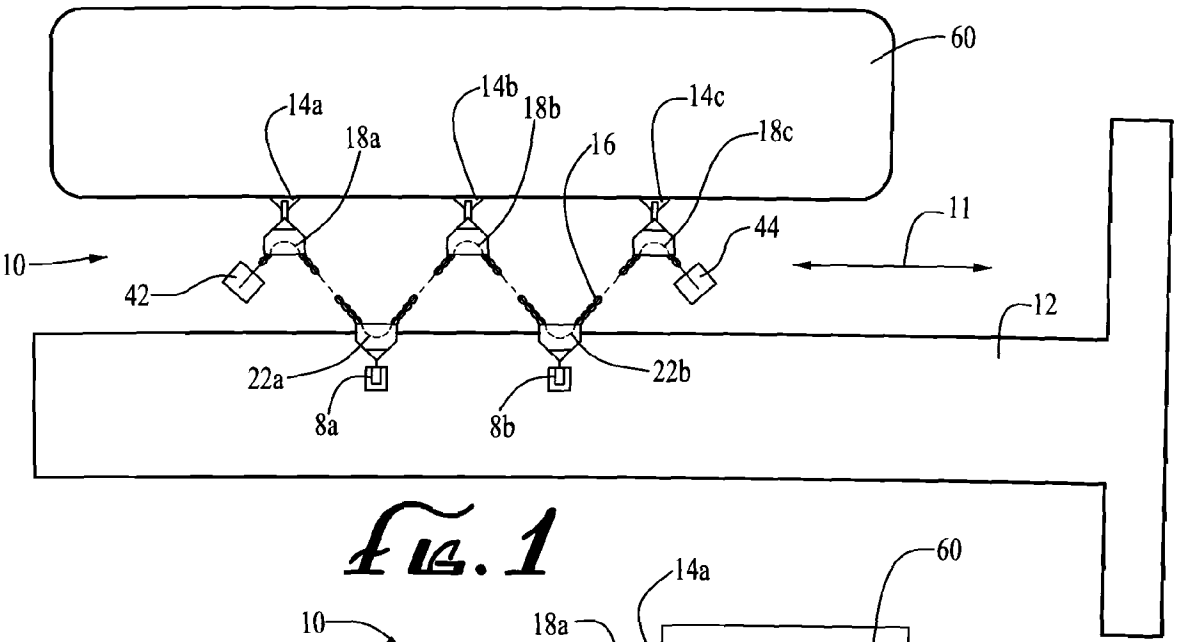
FIG. 1 is a top perspective view of an embodiment of a single-sub-system mooring system having a counterweight hanging off of each of two ship-side sheaves.

It is to be understood that the foregoing and the following detailed description are exemplary and explanatory only and are not to be viewed as being restrictive of the invention, as claimed. Further advantages of this invention will be apparent after a review of the following detailed description of the disclosed embodiments, which are illustrated schematically in the accompanying drawings and in the appended claims.

DETAILED DESCRIPTION

Embodiments of the invention generally relate to mooring systems and methods of/for mooring a sea-going ship. As used herein, the term "ship" describes any floating sea-going vessel, including boats (and floating submarines). Any known mooring line can be used in accordance with the principles of the invention.

Embodiments of load equalizing mooring systems described herein uniformly distribute the high lateral mooring loads to a number of pier (or dock, used interchangeably) and ship attachments. Connections to the dock are made using "dock-side attachments" (or "dock-side mooring attachments"), including, for example, bollards, bitts, and padeyes. Connections to the ship are made using "ship-side attachments" (or "ship-side mooring attachments"), including, for example, standard ship's fitting and custom designed attachment hardware or commercial off the shelf (COTS) magnets and/or suction plates for more generic ship attachments. The term "sheave" is used to describe a fitting that can be attached to a dock, or ship,-side attachment, and includes, for example, quick release hooks, capstans, chain sheaves, and pulleys.

Some embodiments of the system are adapted to restrain the ship under day to day loads as well as 100-year extreme events necessary for a United States Navy type IV mooring. For example, in some embodiments employing two equalizing sub-systems, and adapted to restrain the ship during 100 year extreme events, two 10 ton counterweights installed on each of the two equalizing sub-systems used for a carrier ship provide 120 tons of constant restraint to secure the ship at the dock under normal day to day operations. In some of these embodiments, a stop (or chain travel limiter) is included on the mooring line (typically ahead of the lead sheave) to secure the counterweight at the sheave and mooring loads will then be equalized and distributed as higher applied loads to ship and pier attachments (as the embodiment dictates). In these embodiments, the length of the line suspending the counterweight will be set to allow 100 year extreme excursions in the X, Y and Z directions.

It is noted that embodiments of the self tensioning load equalizing system are not limited to United States Navy type IV moorings, but can also be used for the lower environmental criteria representative of United States Navy type I-III moorings. Also, though a multiple sub-system embodiment(s) was used to exemplarily describe a system in accordance with the principles of the invention that is adapted to restrain the ship during 100-year extreme events necessary for a United States Navy type IV mooring, some embodiments of a mooring system having only one mooring line may be adapted to restrain the ship during 100-year extreme events necessary for a United States Navy type IV mooring.

When combined with other ship and dock-side attachment components such as recessed bins, magnets and suction plates on the ship side and plate anchors or other types of shore side fittings on the dock side, the self tensioning load equalizing mooring systems can facilitate rapid mooring system connections between ships and piers at Navy or commercial berths. By incorporating buoyancy modules into the "dock side" sheaves in conjunction with plate anchors, constant tension multiple leg moorings in open water environments can also be installed.

Embodiments of the invention include single-sub-system embodiments and multiple-sub-system embodiments. Some single-sub-system embodiments are illustrated in FIGS. 1-4. Single sub-system embodiments are referred to as "single-sub-system" embodiments and employ only one mooring line—and therefore only one multi part self tensioning load equalizer sub-system "sub-system" (exemplary, non-exclusive, embodiments of sub-systems in single-sub-system embodiments denoted using reference numbers 10, 30, and 40).

Figure 5:
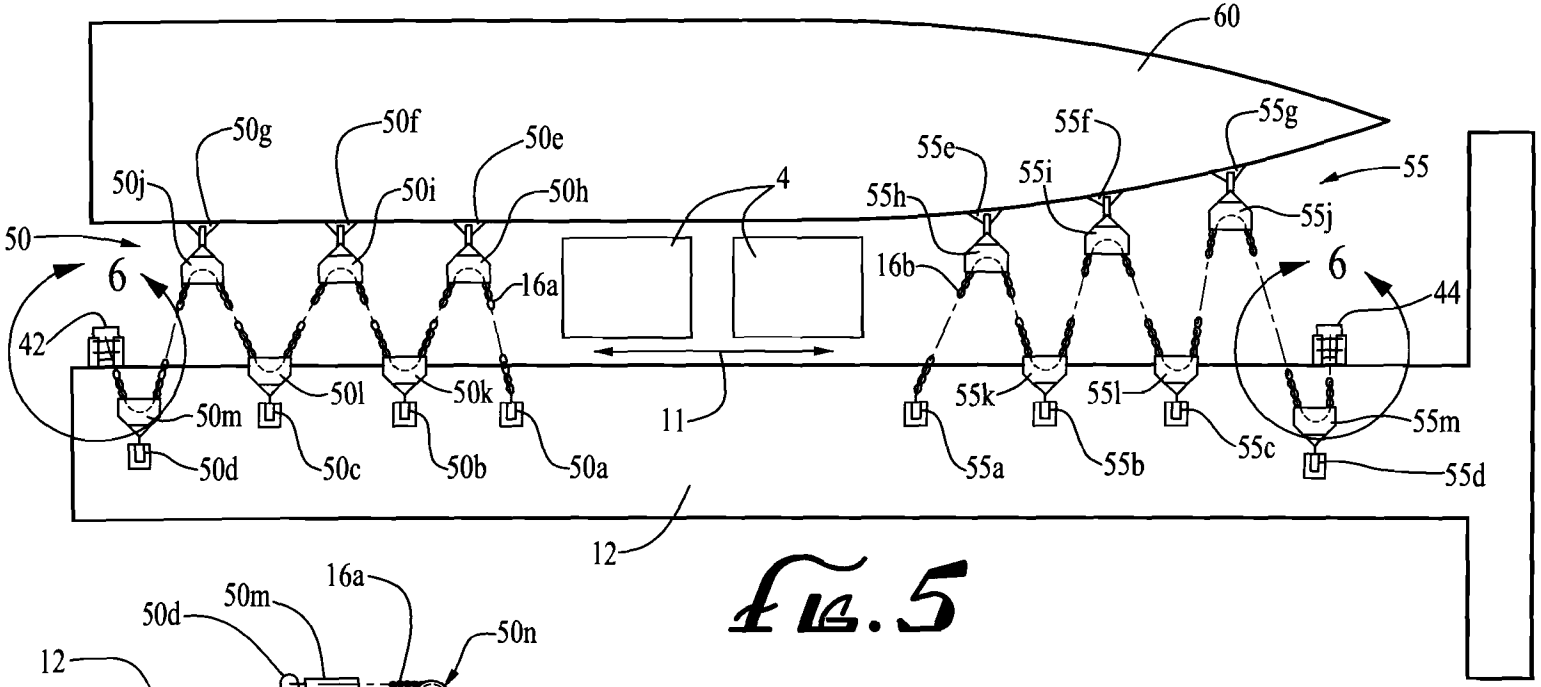
FIG. 5 is a top perspective view of an embodiment of a multiple-sub-system mooring system with each sub-system having a counterweight hanging off of a dock-side sheave and an end of a mooring line connected to a dock-side attachment.
Figure 7:
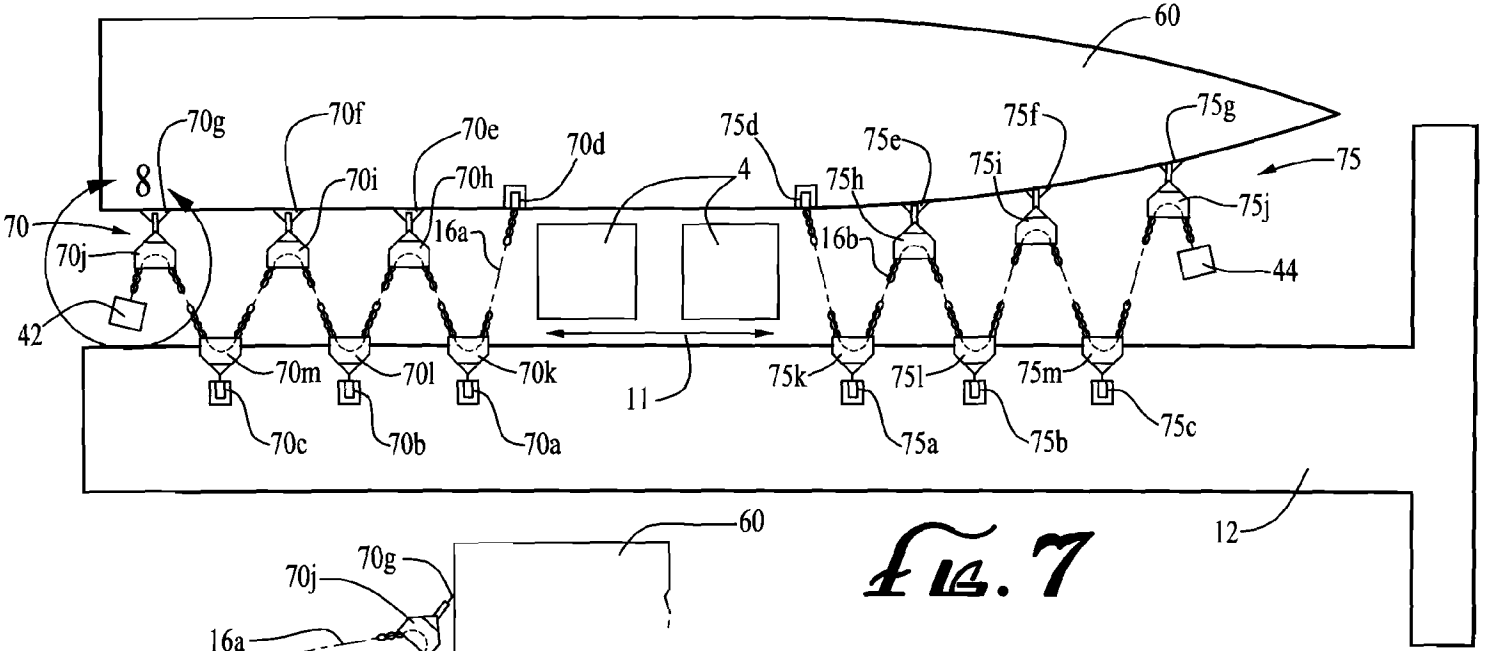
FIG. 7 illustrates a top perspective of an embodiment of a multiple-sub-system mooring system with each sub-system having a counterweight hanging off of a ship-side sheave and an end of a mooring line connected to a ship-side attachment.

Some multiple-sub-system embodiments are illustrated in FIGS. 5 and 7. Multiple-sub-system embodiments include multiple sub-systems (50, 55, 70, 75), with each sub-system using its own mooring line (therefore multiple-sub-system embodiments include multiple mooring lines). Multiple-sub-system embodiments can include any combination of sub-systems. In multiple-sub-system embodiments, one of the sub-systems is secured towards the bow of the ship and another of the sub-systems is secured towards the stern of the ship.

In some single sub-system embodiments and some multiple-sub-system embodiments, the ship is stood off of the pier using breasting barges 4 or breasting platforms. This stand-off distance allows these embodiments to work at low vertical angles, thus improving the efficiency of the mooring line(s).

Once the self tensioning load equalizing system is secured to the ship, the counterweight(s) are installed on the sub-system(s) and the installed sub-system(s) is tensioned to provide active restraint to secure the ship at the mooring. The weight of the counterweight may be adjusted by adding or decreasing additional weight to secure the ship under any desired environmental load conditions. Four sub-system embodiments are described in the following paragraphs.

An exemplary single-sub-system embodiment in which a first end of the mooring line hangs off of a dock-side sheave and is connected to a first counterweight, and a second end of the mooring line hangs off a dock-side sheave and is connected to a second counterweight, is described with reference to FIG. 1. This embodiment includes a plurality of counterweights 42, 44.

This embodiment further includes a plurality of dock-side mooring attachments 8*a*, 8*b* associated with a pier 12 in a longitudinal 11 series and a plurality of ship-side mooring attachments 14*a*, 14*b*, 14*c* associated with a ship 60 in a longitudinal 11 series.

This embodiment further includes a mooring line 16.

This embodiment also includes a plurality of ship-side sheaves 18*a*, 18*b*, 18*c* associated with the plurality of ship-side mooring attachments 14*a*, 14*b*, 14*c* and a plurality of dock-side sheaves 22*a*, 22*b* associated with the plurality of dock-side mooring attachments 8*a*, 8*b*. When the system is in use, the sheaves 18*a*, 18*b*, 18*c*, 22*a*, 22*b* are spatially disposed such that: 1) a plurality of the plurality of dock-side sheaves 22*a*, 22*b* is longitudinally 11 located between a pair of longitudinally 11 successive ship-side sheaves 18*a*, 18*b*, 18*c*; 2) a last of the plurality of ship-sheaves 18*a* is longitudinally 11 located behind a last of the plurality of dock-side sheaves 22*a*; and 3) a first of the plurality of ship-side sheaves 18*c* is longitudinally 11 located before a first of the plurality of dock-side sheaves 22*b*.

When the system is in use, a first end of the mooring line 16 is connected to a first of the plurality of counterweights 44 and a second end of the mooring line 16 is connected to a second of the plurality of counterweights 42.

When the system is in use, the mooring line 16 runs through the first of the plurality of ship-side sheaves 18*c*, alternatingly runs through a longitudinally 11 successive plurality of the plurality of dock-side sheaves 22*b*, 22*a* and the ship-side sheaves 18*b*, 18*a*. As used herein, a mooring line that "alternatingly" runs through a longitudinally 11 successive plurality of a dock-side components (sheaves or attachments) and a ship-side components (sheaves or attachments) runs, in longitudinal order, through a dock-side component to and through a ship-side component, to and through a dock-side component, to and through a ship-side component . . . etc. based on the alternating pattern. The mooring line runs through the last of the plurality of dock-side sheaves 22*a* and the last of the plurality of ship-side sheaves 18*a*. The first and second counterweights 42, 44 are of sufficient weight to provide constant tension to the length of the mooring line 16 from the first of the plurality of ship-side sheaves 18*c* to the last of the plurality of dock-side sheaves 18*a*.

Figure 2:
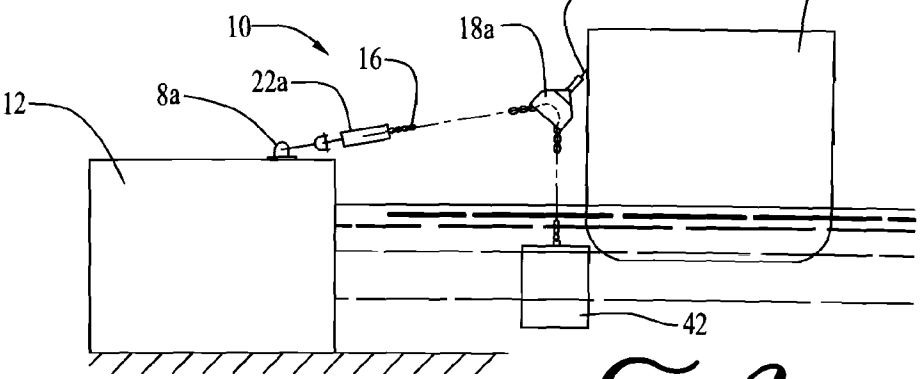
FIG. 2 is a side perspective view of an embodiment of a first mooring connection of an embodiment of a sub-system illustrated in FIG. 1 as a mooring line runs from a dock-side attachment and sheave through a ship-side sheave and is secured to a counterweight.

FIG. 2 illustrates a side view of an embodiment of a first mooring connection of an embodiment of a sub-system illustrated in FIG. 1 as a mooring line 16 runs through a dock-side sheave 22*a* (associated with a dock-side attachment 8*a*) and through a ship-side sheave 18*a* (associated with a ship-side attachment 14*a*) and is secured to a counterweight 42. 12 designates a dock. 60 designates a ship. 10 generally designates the sub-system.

Figure 3:
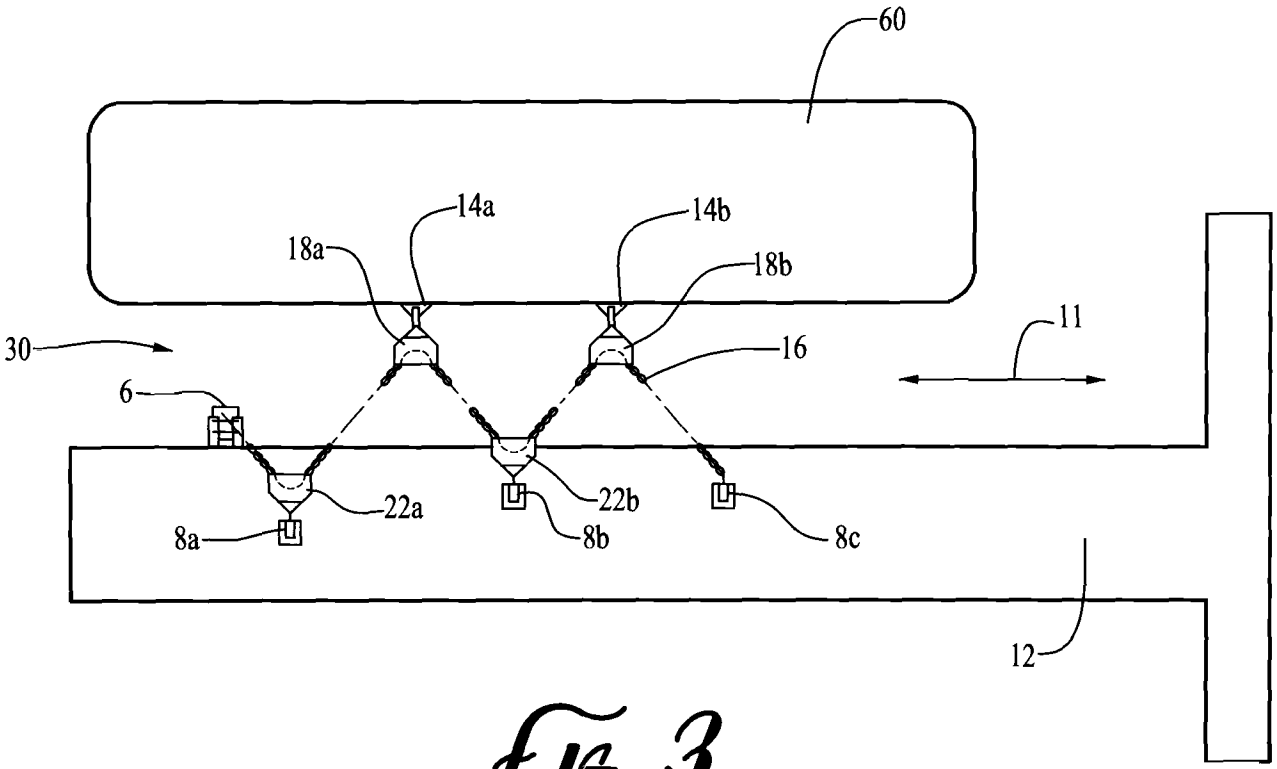
FIG. 3 is a top perspective view of an embodiment of a single-sub-system mooring system having a counterweight hanging off of a dock-side sheave and an end of a mooring line connected to a dock-side attachment.

An exemplary single-sub-system embodiment in which a first end of the mooring line is attached to a dock-side mooring attachment and second end hangs off a dock-side sheave, (with the second end being connected to a counterweight), is described with reference to FIG. 3. This embodiment includes a counterweight 6. 60 designates a ship.

This embodiment also includes a plurality of dock-side mooring attachments 8*a*, 8*b*, 8*c* associated with a pier 12 in a longitudinal 11 series and a plurality of ship-side mooring attachments 14*a* and 14*b* associated with a ship in a longitudinal 11 series.

This embodiment further includes a mooring line 16.

This embodiment further includes a plurality of ship-side sheaves 18*a*, 18*b* associated with the plurality of ship-side mooring attachments 14*a*, 14*b* and a plurality of dock-side sheaves 22*a*, 22*b* associated with a plurality of the plurality of dock-side mooring attachments 8*a*, 8*b*. The mooring attachments 8*a*, 8*b*, 8*c*, 14*a* and 14*b* and sheaves 22*a*, 22*b*, 18*a* and 18*b* are spatially disposed such that, when the system is in use: 1) each of the ship-side sheaves 18*a*, 18*b* is longitudinally 11 located between a pair of longitudinally 11 successive dock-side attachments 8*a*, 8*b*, 8*c*; 2) a last of the plurality of dock-side sheaves 22*a* is longitudinally 11 located behind a last of the plurality of ship-side sheaves 18*a*; and 3) a first of the plurality of dock-side attachments 8*c* is longitudinally 11 located before a first of the plurality of ship-side sheaves 18*b*.

The mooring line 16 is connected to the first of the plurality of dock-side mooring attachments 8*c* and alternatingly runs through a longitudinally 11 successive plurality of the plurality of dock-side sheaves and the ship-side sheaves (18*b*, 22*b*, 18*a* and 22*a*). The mooring line 16 runs through the last of the plurality of ship-side sheaves 18*a* and through the last of the plurality of dock-side sheaves 22*a*. The counterweight 6 is connected to the second end of the mooring line 16; the counterweight 6 is of sufficient weight to provide constant tension to the mooring line 16.

An exemplary single-sub-system embodiment in which a first end of the mooring line hangs off of a dock-side sheave and is connected to a first counterweight, and a second end of the mooring line hangs off a dock-side sheave and is connected to a second counterweight, is described with reference to FIG. 4. This embodiment includes a plurality of counterweights 42, 44. 60 designates a ship.

This embodiment further includes a plurality of dock-side mooring attachments 8*a*, 8*b*, 8*c* associated with a pier 12 in a longitudinal 11 series and a plurality of ship-side mooring attachments 14*a*, 14*b* associated with a ship in a longitudinal 11 series.

This embodiment further includes a mooring line 16.

This embodiment further includes a plurality of ship sheaves 18*a*, 18*b* associated with the plurality of ship-side mooring attachments 14*a*, 14*b* and a plurality of dock-side sheaves 22*a*, 22*b*, 22*c* associated with the plurality of dock-side mooring attachments 8*a*, 8*b*, 8*c*. The sheaves are spatially disposed such that, when the system is in use: 1) each of the plurality of ship-side sheaves 18*a*, 18*b* is longitudinally 11 located between a pair of longitudinally 11 successive dock-side sheaves 22*a*, 22*b*, 22*c*; 2) a last of the plurality of dock-side sheaves 22*a* is longitudinally 11 located behind a last of the plurality of ship-side sheaves 18*a*; and 3) a first of the plurality of dock-side sheaves 22*c* is longitudinally 11 located before a first of the plurality of ship-side sheaves 18*c*.

When this system is in use, a first end of the mooring line 16 is connected to a first of the plurality of counterweights 44 and a second end of the mooring line 16 is connected to a second of the plurality of counterweights 42. When this system is in use, the mooring line 16 runs through the first of the plurality of dock-side sheaves 22*c*, alternatingly runs through a longitudinally 11 successive plurality of the plurality of ship-side sheaves 18*b*, 18*a* and dock-side sheaves 22*a*, 22*b*, and runs through the last of the plurality of ship-side sheaves 18*a* and the last of the plurality of dock-side sheaves 22*a*; the first and second counterweights 42, 44 are of sufficient weight to provide constant tension to the length of the mooring line 16 from the first of the plurality of dock-side sheaves 22*c* to the last of the plurality of dock-side sheaves 22*a*.

An exemplary single-sub-system embodiment in which a first end of the mooring line is attached to a ship-side mooring attachment and second end hangs off a ship-side sheave, (with the second end being connected to a counterweight), is described with reference to sub-system 70 FIG. 7 (note however that FIG. 7 illustrates two sub-systems). This embodiment includes a counterweight 42.

This embodiment also includes a plurality of dock-side mooring attachments 70*a-c* associated with a pier 12 in a longitudinal 11 series and a plurality of ship-side mooring attachments 70*d-g* associated with a ship 60 in a longitudinal 11 series.

This embodiment further includes a mooring line 16*a*.

This embodiment further includes a plurality of ship-side sheaves 70*h-j* associated with a plurality of the plurality of ship-side mooring attachments 70*d-g* and a plurality of dock-side sheaves 70*k-m* associated with the plurality of dock-side mooring attachments 70*a-c*. The mooring attachments and sheaves are spatially disposed such that, when the system is in use: 1) each of the dock-side sheaves 70*k-m* is longitudinally 11 located between a pair of longitudinally 11 successive ship-side mooring attachments 70*d-g*; 2) a last of the plurality of ship-side sheaves 70*j* is longitudinally 11 located after a last of the plurality of dock-side sheaves 70*m*; and 3) a first of the plurality of ship-side attachments 70*d* is longitudinally 11 located before a first of the plurality of dock-side sheaves 70*k*.

The mooring line 16*a* is connected to the first of the plurality of ship-side mooring attachments 70*d* and alternatingly runs through a longitudinally 11 successive plurality of the plurality of dock-side sheaves 70*k-m* and the ship-side sheaves 70*h-j*. The mooring line 16*a* runs through the last of the plurality of dock-side sheaves 70*m* and the last of the plurality of ship-side sheaves 70*j*. The counterweight 42 is connected to the second end of the mooring line 16*a*; the counterweight 42 is of sufficient weight to provide constant tension to the mooring line 16*a*.

Other single-sub-system embodiments that are not illustrated but that are considered embodiments of the invention include embodiments in which: 1) a first end of the mooring line is attached to a dock-side mooring attachment and second end hangs off a ship-side sheave, with the second end being connected to a counterweight; 2) a first end of the mooring line is attached to a ship-side mooring attachment and a second end hangs off a dock-side sheave; 3) a first end of the mooring line hangs off of a ship-side sheave and is connected to a first counterweight and a second end of the mooring line hangs off a dock-side sheave and is connected to a second counterweights; and 4) a first end of the mooring line hangs off of a dock-side sheave and is connected to a first counterweight and a second end of the mooring line hangs off a ship-side sheave and is connected to a second counterweight.

As noted supra, some embodiments of load equalizing systems in accordance with the principles of the invention include multiple sub-systems selected from the group of single-sub-system embodiments described supra (including those in paragraph 0044). For exemplary purposes, two multi-sub-system embodiments are described. However, multi-sub-system embodiments can include any combination of single-sub-systems within one or more of the single-sub-system embodiment categories described supra (including those in paragraph 0044).

FIG. 5 includes exemplary self tensioning load equalizer sub-systems (a rear-side sub-system and a lead-side sub-system) 50, 55. The embodiment illustrated in FIG. 5 includes a plurality of counterweights 42, 44, one counterweight associated with each of the two self tensioning load equalizer sub-systems 50, 55.

Figure 6:
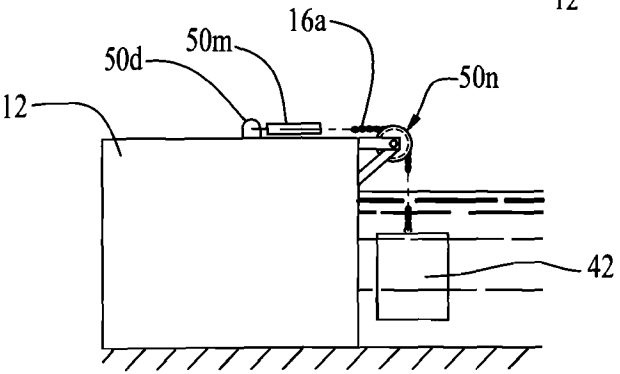
FIG. 6 is a side perspective view a partial illustration of an embodiment of a sub-system having a pulley over which a mooring line runs between a counterweight and a dock-side sheave and dock-side attachment.

FIG. 6 partially illustrates an embodiment of a sub-system having a pulley 50*n* (associated with a dock 12) over which the mooring line 16*a* runs between a counterweight 42 and a dock-side sheave 50*m* and dock-side attachment 50*d*. Note that a pulley type system exemplarily illustrated in FIG. 6 is used in some embodiments of each of the single-sub-system embodiment categories (including those in paragraph 0044)

With reference to FIG. 5, this embodiment further includes a plurality of rear-side sub-system dock-side mooring attachments 50*a-d* associated with a pier 12 in a longitudinal 11 series, and a plurality of rear-side sub-system ship-side mooring attachments 50*e-g*, associated with a ship 60 in a longitudinal 11 series. In this embodiment, a first of the plurality of rear-side sub-system dock-side attachments 50*a* is longitudinally 11 located before a first of the plurality of rear-side sub-system ship-side sheaves 50*h*.

This embodiment further includes a plurality of front-side sub-system dock-side mooring attachments 55*a-d* associated with a pier 12 in a longitudinal 11 series and a plurality of front-side sub-system ship-side mooring attachments 55*e-g* associated with a ship 60 in a longitudinal 11 series. A first of the plurality of front-side sub-system dock-side attachments 55*a* is longitudinally 11 located before a first of the plurality of ship-side sheaves 55*h*.

This embodiment further includes a plurality of mooring lines 16*a*, 16*b*.

This embodiment further includes a plurality of rear-side sub-system ship-side sheaves 50*h-j* associated with the plurality of rear-side sub-system ship-side mooring attachments 50*e-g*, and a plurality of rear-side sub-system dock-side sheaves 50*k-m* associated with a plurality of the plurality of rear-side sub-system dock-side mooring attachments 50*b-d*. In this embodiment, each of the plurality of rear-side sub-system ship-side sheaves 50*h-j* is longitudinally 11 located between a pair of longitudinally 11 successive plurality of rear-side sub-system dock-side attachments 50*a-d*. A last of the plurality of rear-side sub-system dock-side sheaves 50*m* is longitudinally 11 located behind a last of the plurality of rear-side sub-system ship-side sheaves 50*j*.

This embodiment further includes a plurality of front-side sub-system ship-side sheaves 55*h-j* associated with the plurality of front-side sub-system ship-side mooring attachments 55*e-g* and a plurality of front-side sub-system dock-side sheaves 55*k-m* associated with a plurality of the plurality of front-side sub-system dock-side mooring attachments 55*b-d*. In this embodiment, a plurality of the plurality of front-side sub-system ship-side sheaves 55*h-j* is longitudinally 11 located between a pair of longitudinally 11 successive plurality of front-side sub-system dock-side attachments 55*a-d*. A last of the plurality of front-side sub-system dock-side sheaves 55*m* is longitudinally 11 located behind a last of the plurality of front-side sub-system ship-side sheaves 55*j*.

In this embodiment, a first end of a first of the plurality of mooring lines 16*a* is connected to the first of the plurality of rear-side sub-system dock-side attachments 50*a*. The first of the plurality of mooring lines 16*a* alternatingly runs through a longitudinally 11 successive plurality of the plurality of rear-side sub-system ship-side sheaves 50*h-j* and the rear-side sub-system dock-side sheaves 50*k-m*. The first of the plurality of mooring lines 16*a* runs through the last of the plurality of rear-side sub-system ship-side sheaves 50*j* to (and through) the last of the plurality of rear-side sub-system dock-side sheaves 50*m*.

A first of the plurality of counterweights 42 is connected to a second end of the first of the plurality of mooring lines 16*a*; the first of the plurality of counterweights 42 is of sufficient weight to provide constant tension throughout the length of the first of the plurality of mooring lines 16*a* from the first of the plurality of rear-side sub-system dock-side attachments 50*a* to the last of the plurality of front-side sub-system dock-side sheaves 50*m*.

In this embodiment, a first end of a second of the plurality of mooring lines 16*b* is connected to the first of the plurality of front-side sub-system dock-side attachments 55*a*. The second of the plurality of mooring lines 16*b* alternatingly runs through a longitudinally 11 successive plurality of the plurality of front-side sub-system ship-side sheaves 55*h-j* and the front-side sub-system dock-side sheaves 55*k-m*. The second of the plurality of mooring lines 16*b* runs through the last of the plurality of front-side sub-system ship-side sheaves 55*a* to (and through) the last of the plurality of front-side sub-system dock-side sheaves 55*m*.

A second of the plurality of counterweights 44 is connected to a second end of the second of the plurality of mooring lines 16*b*; the counterweight 44 is of sufficient weight to provide constant tension throughout the length of the second of the plurality of mooring lines 16*b* from the first of the plurality of front-side sub-system dock-side attachments 55*a* to the last of the plurality of front-side sub-system dock-side sheaves 55*m*.

Figure 8:
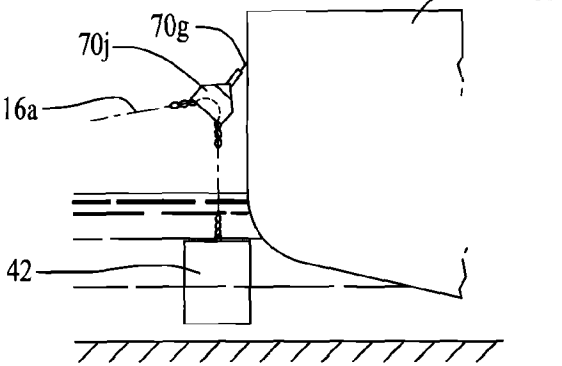
FIG. 8 is a side perspective view of a partial illustration of an embodiment of a sub-system having a ship-side sheave through which a mooring line runs.

Another embodiment of multiple sub-system embodiments is described with reference to FIG. 7. FIG. 8 partially illustrates an embodiment of a sub-system having a ship-side chain sheave 70*j* through which the mooring line 16*a* runs between a counterweight 42 and a dock-side sheave (not illustrated).

FIG. 7 includes two self tensioning load equalizer sub-systems (a rear-side sub-system and a lead-side sub-system) 70, 75. In the embodiment illustrated in FIG. 7, each sub-system includes a mooring line having an end that is associated with a counterweight that hangs off a sheave associated with the ship and another end connected to a ship-side attachment; however, other multiple sub-system embodiments include embodiments in which a plurality of the sub-systems includes a mooring line having each end associated with a counterweight that hangs off a sheave associated with the ship.

With reference to FIG. 7, this embodiment includes a plurality of counterweights 42, 44.

This embodiment also includes a plurality of rear-side sub-system dock-side mooring attachments 70*a-c* associated with a pier 12 in a longitudinal 11 series and a plurality of rear-side sub-system ship-side mooring attachments 70 *d-g* associated with a ship 60 in a longitudinal 11 series.

This embodiment also includes a plurality of front-side sub-system dock-side mooring attachments 75*a-c* associated with a pier 12 in a longitudinal 11 series and a plurality of front-side sub-system ship-side mooring attachments 75 *d-g* associated with a ship 60 in a longitudinal 11 series.

This embodiment further includes a plurality of mooring lines 16*a*, 16*b*.

This embodiment further includes a plurality of rear-side sub-system ship-side sheaves 70*h-j* associated with a plurality of rear-side sub-system ship-side mooring attachments 70*e-g* and a plurality of rear-side sub-system dock-side sheaves 70*k-m* associated with the plurality of rear-side sub-system dock-side mooring attachments 70*a-c*.

This embodiment further includes a plurality of front-side sub-system ship-side sheaves 75*h-j* associated with the plurality of front-side sub-system ship-side mooring attachments 75*e-g* and a plurality of front-side sub-system dock-side sheaves 75*k-m* associated with the plurality of front-side sub-system dock-side mooring attachments 75*a-c*.

This embodiment further includes a plurality of the plurality of rear-side sub-system dock-side sheaves 70*a-c* is longitudinally 11 located between a pair of longitudinally 11 successive plurality of rear-side sub-system ship-side attachments 70*d-g*. In this embodiment, a last of the plurality of rear-side sub-system ship-side sheaves 70*j* is longitudinally 11 located behind a last of the plurality of rear-side sub-system sock-side sheaves 70*m*. In this embodiment, a first of the plurality of rear-side sub-system ship-side attachments 70*d* is longitudinally 11 located before a first of the plurality of dock-side sheaves 70*k*.

In this embodiment, a first end of a first of the plurality of mooring lines 16*a* is connected to the first of the plurality of rear-side sub-system ship-side attachments 70*d*. The first of the plurality of mooring lines 16*a* alternatingly runs through a longitudinally 11 successive plurality of the plurality of rear-side sub-system dock-side sheaves 70*k-m* and the rear-side sub-system ship-side sheaves 70*h-j*. The first of the plurality of mooring lines 16*a* runs through the last of the plurality of rear-side sub-system ship-dock sheaves 70*m* to the last of the plurality of rear-side sub-system ship-side sheaves 70*j*.

A first of the plurality of counterweights 42 is connected to a second end of the first of the plurality of mooring lines 16*a*; the first of the plurality of counterweights 42 is of sufficient weight to provide constant tension throughout the length of the first of the plurality of mooring lines 16*a* from the first of the plurality of rear-side sub-system ship-side attachments 70*d* to the last of the plurality of rear-side sub-system ship-side sheaves 70*j*.

In this embodiment, a plurality of front-side sub-system ship-side sheaves 75*h-j* is associated with a plurality of front-side sub-system ship-side mooring attachments 75*e-g* and a plurality of front-side sub-system dock-side sheaves 75*k-m* associated with the plurality of front-side sub-system dock-side mooring attachments 75*a-c*. In this embodiment, the mooring attachments and sheaves are spatially disposed such that, when the system is in use: 1) each of the plurality of front-side sub-system dock-side sheaves 75*k-m* is longitudinally 11 located between a pair of longitudinally 11 successive plurality of front-side sub-system ship-side attachments 75*d-g*; 2) a last of the plurality of front-side sub-system ship-side sheaves 75*j* is longitudinally 11 located behind a last of the plurality of front-side sub-system dock-side sheaves 7*dm*; and 3) a first of the plurality of front-side sub-system ship-side attachments 75*a-c* is longitudinally 11 located before a first of the plurality of front-side sub-system dock-side sheaves 75*k*.

When in use, in this embodiment, a first end of a second of the plurality of mooring lines 16*b* is connected to the first of the plurality of front-side sub-system ship-side attachments 75*d*. The second of the plurality of mooring lines 16*b* alternatingly runs through a longitudinally 11 successive plurality of the plurality of front-side sub-system dock-side sheaves 75*k-m* and the front-side sub-system ship-side sheaves 75*h-j*. The second of the plurality of mooring lines 16*b* runs through the last of the plurality of front-side sub-system dock-side sheaves 75*m* to the last of the plurality of front-side sub-system ship-side sheaves 75*j*; the second of the plurality of mooring lines 16*b* runs through the last of the plurality of front-side sub-system ship-side sheaves 7575*j*.

When in use, in this embodiment, a second of the plurality of counterweights 44 is connected to a second end of the second of the plurality of mooring lines 16*b*; the counterweight 44 is of sufficient weight to provide constant tension throughout the length of the second of the plurality of mooring lines 16*b* from the first of the plurality of front-side sub-system ship-side attachments 75*d* to the last of the plurality of front-side sub-system ship-side sheaves 75*j*.

Methods

Some method embodiments employing some embodiments of sub-systems are described herein. Note however that method embodiments include permutations of possible combinations of sub-systems not disclosed herein; employment of all possible permutations of combinations of sub-systems (as described herein) is contemplated and appreciated.

Exemplary Method Embodiments Section 1

With reference to sub-system 50 in FIG. 5, all of the method embodiments described in this Exemplary Method Embodiments Section 1 include the following base permutation (base permutation 1):

disposing a first mooring line 16*a* through a plurality of first sub-system ship-side sheaves 50*h-j* and a plurality of first sub-system dock-side sheaves 50*k-m* (associated with a plurality of a plurality of dock-side attachments 50*a-d*) such that the first mooring line 16*a* alternatingly runs through a longitudinally 11 successive plurality of the plurality of first sub-system ship-side sheaves 50*h-j* and the plurality of first sub-system dock-side sheaves 50*k-m*, the last of the plurality of first sub-system ship-side sheaves 50*j* and the last of the plurality of first sub-system dock-side sheaves 50*m*, wherein each of the plurality of first sub-system ship-side sheaves 50*h-j* is longitudinally 11 located between a longitudinally 11 successive pair of first sub-system dock-side attachments 50*a-d*, a last of the plurality of first sub-system dock-side sheaves 50*m* is longitudinally 11 located after a last of the plurality of first sub-system ship-side sheaves 50*j*, and a first of the plurality of first sub-system dock-side attachments 50*a* is longitudinally 11 located before a first of the plurality of first sub-system ship-side sheaves 50*h*; and providing constant tension to the length of the first mooring line 16*a* from the first of the plurality of first sub-system dock-side attachments 50*a* to the last of the first sub-system dock-side sheaves 50*m* by securing a first end of the first mooring line 16*a* to the first of the plurality of first sub-system dock-side attachments 50*a* and securing a first counterweight to a second end of the first mooring line 16*a*. In some of these embodiments, the first mooring line 16*a* is of sufficient length, and the first counterweight is of sufficient weight, to restrain the ship during 100-year extreme events consistent with Mooring Service Type (MST) IV mooring design standards.

With reference to sub-system 55 in FIG. 5, some of these embodiments further (with respect to the base permutation 1) include disposing a second mooring line 16*b* through a plurality of second sub-system ship-side sheaves 55*h-j* and a plurality of second sub-system dock-side sheaves 55*k-m* such that the second mooring line 16*b* alternatingly runs through a longitudinally 11 successive plurality of the plurality of second sub-system dock-side sheaves 55*k-m* and the second sub-system ship-side sheaves 55*h-j* and the second mooring line 16*b* runs through the last of the plurality of second sub-system ship-side sheaves 55*j* and the last of the plurality of second sub-system dock-side sheaves 55*m*, wherein each of the plurality of second sub-system ship-side sheaves 55*h-j* is longitudinally 11 located between a longitudinally 11 successive pair of second sub-system dock-side attachments 55*a-d*, wherein a last of the plurality of second sub-system dock-side sheaves 55*m* is longitudinally 11 located after a last of the plurality of second sub-system ship-side sheaves 55*j*, and wherein a first of the plurality of second sub-system dock-side attachments 55*a* is longitudinally 11 located before a first of the plurality of second sub-system ship-side sheaves 55*h*; and providing constant tension to the length of the second mooring line 16*b* from the first of the plurality of second sub-system dock-side attachments 55*a* to the last of the second sub-system dock-side sheaves 55*m* by securing a first end of the second mooring line 16*b* to the first of the plurality of second sub-system dock-side attachments 55*a* and securing a second counterweight 44 to a second end of the second mooring line 16*b*. In some of these embodiments, the second mooring line 16*b* is of sufficient length, and the second counterweight 44 is of sufficient weight, to restrain the ship 60 during 100-year extreme events consistent with Mooring Service Type (MST) IV mooring standards.

Figure 4:
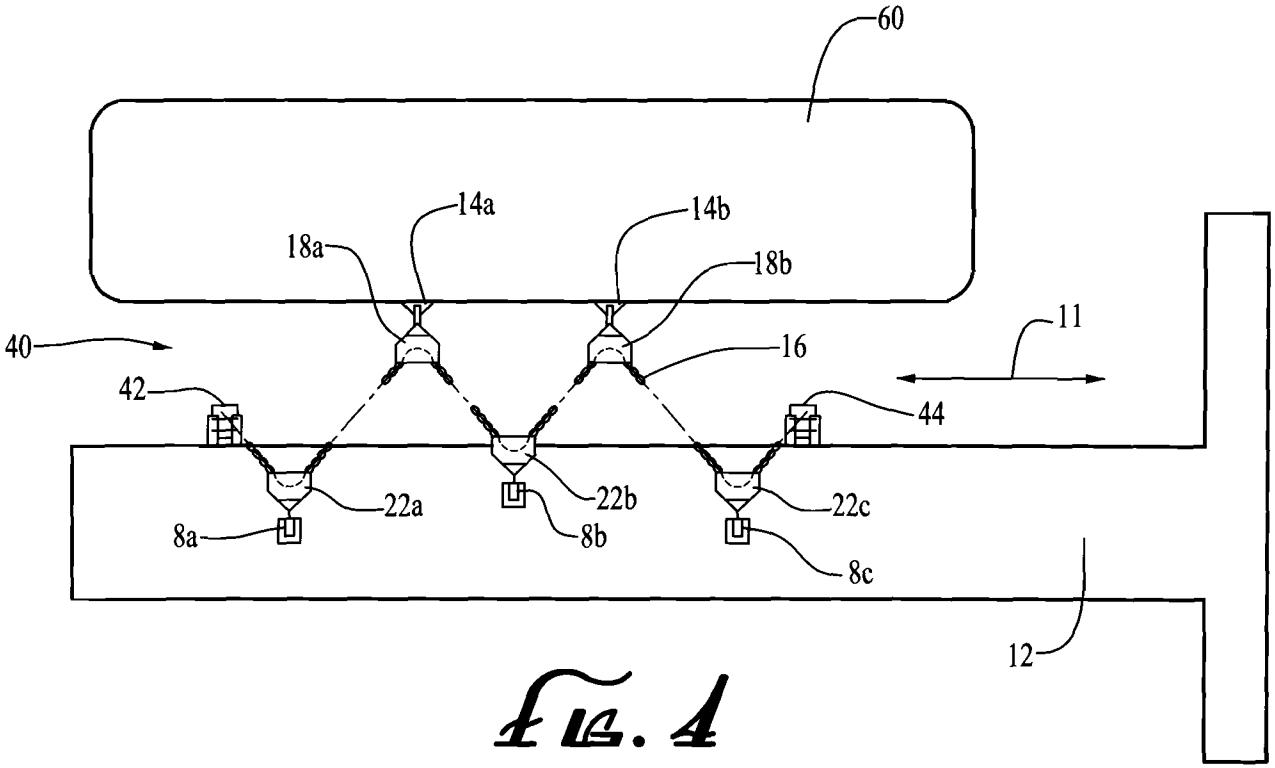
FIG. 4 is a top perspective view of an embodiment of a single-sub-system mooring system having a counterweight hanging off of each of two dock-side sheaves.

With reference to sub-system 40 in FIG. 4, some of these method embodiments further (with respect to the base permutation 1) include disposing a second mooring line 16 through a plurality of second sub-system dock-side sheaves 22*a-c* and a plurality of second sub-system ship-side sheaves 18*a, b* such that the second mooring line 16 alternatingly runs through a longitudinally 11 successive plurality of the plurality of second sub-system dock-side sheaves 22*a-c* and the plurality of second sub-system ship-side sheaves 18*a,b* and the second mooring line runs 16 through the last of the plurality of second sub-system ship-side sheaves 18*a* and the last of the plurality of second sub-system dock-side sheaves 22*a*, wherein each of the plurality of second sub-system ship-side sheaves 18*a,b* is longitudinally 11 located between a longitudinally 11 successive pair of the plurality of second sub-system dock-side sheaves 22*a-c*, wherein a last of the plurality of second sub-system dock-side sheaves 22*a* is longitudinally 11 located after a last of the plurality of second sub-system ship-side sheave 18*a*, and wherein a first of the plurality of second sub-system dock-side sheaves 22*c* is longitudinally 11 located before a first of the plurality of second sub-system ship-side sheaves 18*b;* securing a second counterweight 42 to a first end of the second mooring line 16; and providing constant tension to the length of the mooring line 16 from the first of the plurality of second sub-system dock-side sheaves 22*c* to the last of the plurality of second sub-system dock-side sheaves 22*a* by securing a second counterweight 44 to a second end of the second mooring line 16.

With reference to sub-system 75 in FIG. 7, some of these embodiments further (with respect to base permutation 2)

include disposing a mooring line 16*b* through a plurality of second sub-system ship-side sheaves 75*h-j* and a plurality of second sub-system dock-side sheaves 75*k-m* such that the second mooring line 16*b* alternatingly runs through a longitudinally 11 successive plurality of the plurality of second sub-system ship-side sheaves 75*h-j* and the second sub-system dock-side sheaves 75*k-m* and the second mooring line 16*b* runs through the last of the plurality of second sub-system ship-side sheaves 75*j* to and through the last of the plurality of second sub-system dock-side sheaves 75*m*, wherein each of the plurality of second sub-system dock-side sheaves 75*k-m* is longitudinally 11 located between a longitudinally 11 successive pair of second sub-system ship-side attachments 75*d-g*, wherein a last of the plurality of second sub-system ship-side sheaves 75*j* is longitudinally 11 located after a last of the plurality of second sub-system dock-side sheaves 75*m*, and wherein a first of the plurality of second sub-system ship-side attachments 75*d* is longitudinally 11 located before a first of the plurality of second sub-system dock-side sheaves 75*k*; and providing constant tension to the length of the second mooring line 16*b* from the first of the plurality of second sub-system ship-side attachment 75*d* to the last of the second sub-system ship-side sheave 75*j* by securing a first end of the second mooring line 16*b* to the first of the plurality of second sub-system ship-side attachments 75*d* and securing a second counterweight 42 to a second end of the second mooring line 16*b*. In some of these embodiments, the first mooring line and the second mooring line are of sufficient length, and the first counterweight the counterweight and the third counterweight are of sufficient weight, to restrain the ship during 100-year extreme events consistent with Mooring Service Type (MST) IV mooring design standards.

Exemplary Method Embodiments Section 2

With reference to sub-system 40 in FIG. 4, all of the method embodiments described in this Exemplary Method Embodiments Section 2 include the following base permutation (base permutation 2):

disposing a first mooring line 16 through a plurality of first sub-system dock-side sheaves 22*a-c* and a plurality of first sub-system ship-side sheaves 18*a, b* such that the first mooring line 16 alternatingly runs through a longitudinally 11 successive plurality of the plurality of first sub-system dock-side sheaves 22*a-c* and the plurality of first sub-system ship-side sheaves 18*a,b* and the first mooring line runs 16 through the last of the plurality of first sub-system ship-side sheaves 18*a* and the last of the plurality of first sub-system dock-side sheaves 22*a*, wherein each of the plurality of first sub-system ship-side sheaves 18*a,b* is longitudinally 11 located between a longitudinally 11 successive pair of the plurality of first sub-system dock-side sheaves 22*a-c*, wherein a last of the plurality of first sub-system dock-side sheaves 22*a* is longitudinally 11 located after a last of the plurality of first sub-system ship-side sheave 18*a*, and wherein a first of the plurality of first sub-system dock-side sheaves 22*c* is longitudinally 11 located before a first of the plurality of first sub-system ship-side sheaves 18*b;* securing a first counterweight 42 to a first end of the first mooring line 16; and providing constant tension to the length of the mooring line 16 from the first of the plurality of first sub-system dock-side sheaves 22*c* to the last of the plurality of first sub-system dock-side sheaves 22*a* by securing a second counterweight 44 to a second end of the first mooring line 16.

In some of these embodiments, the first mooring line 16 is of sufficient length, and the first counterweight 42 and the second counterweight 44 are of sufficient weight, to restrain the ship 60 during 100-year extreme events consistent with Mooring Service Type (MST) IV design standards.

With reference to subsystem 10 in FIG. 1, some of these embodiments further include, i.e., in addition to base permutation 4, disposing a second mooring line 16 through a plurality of second sub-system ship-side sheaves 18*a-c* and a plurality of second sub-system dock-side sheaves 22*a,b* such that the second mooring line 16 alternatingly runs through a longitudinally 11 successive plurality of the plurality of second sub-system ship-side sheaves 18*a-c* and the second sub-system dock-side sheaves 22*a,b* and the second mooring line 16 runs through the last of the plurality of second sub-system dock-side sheaves 22*a* and the last of the plurality of second sub-system ship-side sheaves 18*a*, wherein each of the plurality of second sub-system dock-side sheaves 22*a,b* is longitudinally 11 located between a longitudinally 11 successive pair of second sub-system ship-side sheaves 18*a-c*, wherein a last of the plurality of second sub-system ship-side sheaves 18*a* is longitudinally 11 located after a last of the plurality of second sub-system dock-side sheave 22*a*, and wherein a first of the plurality of second sub-system ship-side sheaves 18*c* is longitudinally 11 located before a first of the plurality of second sub-system dock-side sheaves 22*b*; and providing constant tension to the length of the second mooring line 16 from the first of the plurality of second sub-system ship-side sheaves 18*c* to the last of the second sub-system ship-side sheaves 18*a* by securing a third counterweight 42 to a first end of the second mooring line 16 and securing a fourth counterweight 44 to a second end of the second mooring line 16.

In some of these embodiments, the first mooring line and the second mooring line are of sufficient length, and the first counterweight the second counterweight and the third counterweight are of sufficient weight, to restrain the ship during 100-year extreme events consistent with Mooring Service Type (MST) IV mooring.

With reference to sub-system 70 in FIG. 7, some of these embodiments further (with respect to base permutation 2) include disposing a first mooring line 16*a* through a plurality of first sub-system ship-side sheaves 70*h-j* and a plurality of first sub-system dock-side sheaves 70*k-m* such that the first mooring line 16*a* alternatingly runs through a longitudinally 11 successive plurality of the plurality of first sub-system ship-side sheaves 70*h-j* and the first sub-system dock-side sheaves 70*k-m* and the first mooring line 16*a* runs through the last of the plurality of first sub-system ship-side sheaves 70*j* to and through the last of the plurality of first sub-system dock-side sheaves 70*m*, wherein each of the plurality of first sub-system dock-side sheaves 70*k-m* is longitudinally 11 located between a longitudinally 11 successive pair of first sub-system ship-side attachments 70*d-g*, wherein a last of the plurality of first sub-system ship-side sheaves 70*j* is longitudinally 11 located after a last of the plurality of first sub-system dock-side sheaves 70*m*, and wherein a first of the plurality of first sub-system ship-side attachments 70*d* is longitudinally 11 located before a first of the plurality of first sub-system dock-side sheaves 70*k*; and providing constant tension to the length of the first mooring line 16*a* from the first of the plurality of first sub-system ship-side attachment 70*d* to the last of the first sub-system ship-side sheave 70*j* by securing a first end of the first mooring line 16*a* to the first of the a plurality of first sub-system ship-side attachments 70*d* and securing a first counterweight 42 to a second end of the first mooring line 16*a*.

Exemplary Method Embodiments Section 3

With reference to subsystem 10 in FIG. 1, all of the method embodiments described in this Exemplary Method Embodiments Section 3 include the following base permutation (base permutation 3):

disposing a first mooring line 16 through a plurality of first sub-system ship-side sheaves 18*a*, 18*b* and a plurality of first sub-system dock-side sheaves 22*a-c* such that the first mooring 16 line alternatingly runs through (longitudinally 11 successive of) the plurality of first sub-system ship-side sheaves 18*a*, 18*b* and the first sub-system dock-side sheaves 22*a-c*, wherein the first of the plurality of mooring lines 16 runs through the last of the plurality of first sub-system ship-side sheaves 18*b* and the last of the plurality of first sub-system dock-side sheaves 22*c*, wherein each of the plurality of first sub-system ship-side sheaves 18*a*, 18*b* is longitudinally 11 located between a longitudinally 11 successive pair of the plurality of first sub-system dock-side sheaves 22*a-c*, wherein a last of the plurality of first sub-system dock-side sheaves 22*c* is longitudinally 11 located after a last of the plurality of first sub-system ship-side sheave 18*b*, and wherein a first of the plurality of first sub-system dock-side sheaves 22*a* is longitudinally 11 located before a first of the plurality of first sub-system ship-side sheaves 18*a*; and providing constant tension to the length of the first mooring line 16 from the first of the first sub-system dock-side sheave 22*a* to the last of the first sub-system dock-side sheave 22*c* by securing a first counterweight 42 to a first end of the first mooring line 16 and securing a second counterweight 44 to a second end of the first mooring line 16.

With reference to sub-system 55 in FIG. 5, some of these embodiments further include, i.e., in addition to base permutation 3, disposing a second mooring line 16*b* through a plurality of second sub-system ship-side sheaves 55*h-j* and a plurality of second sub-system dock-side sheaves 55*k-m* such that the second mooring line 16*b* alternatingly runs through a longitudinally 11 successive plurality of the plurality of second sub-system dock-side sheaves 55*k-m* and the second sub-system ship-side sheaves 55*h-j* and the second mooring line 16*b* runs through the last of the plurality of second sub-system ship-side sheaves 55*j* and the last of the plurality of second sub-system dock-side sheaves 55*m*, wherein each of the plurality of second sub-system ship-side sheaves 55*h-j* is longitudinally 11 located between a longitudinally 11 successive pair of second sub-system dock-side attachments 55*a-d*, wherein a last of the plurality of second sub-system dock-side sheaves 55*m* is longitudinally 11 located after a last of the plurality of second sub-system ship-side sheaves 55*j*, and wherein a first of the plurality of second sub-system dock-side attachments 55*a* is longitudinally 11 located before a first of the plurality of second sub-system ship-side sheaves 55*h*; and providing constant tension to the length of the second mooring line 16*b* from the first of the plurality of second sub-system dock-side attachments 55*a* to the last of the second sub-system dock-side sheaves 55*m* by securing a first end of the second mooring line 16 to the first of the plurality of second sub-system dock-side attachments 55*a* and securing a third counterweight to a second end of the second mooring line 16*b*.

With reference to subsystem 10 in FIG. 1, some of these embodiments further include, i.e., in addition to base permutation 4, disposing a second mooring line 16 through a plurality of second sub-system ship-side sheaves 18*a-c* and a plurality of second sub-system dock-side sheaves 22*a,b* such that the second mooring line 16 alternatingly runs through a longitudinally 11 successive plurality of the plurality of second sub-system ship-side sheaves 18*a-c* and the second sub-system dock-side sheaves 22*a,b* and the second mooring line 16 runs through the last of the plurality of second sub-system dock-side sheaves 22*a* and the last of the plurality of second sub-system ship-side sheaves 18*a*, wherein each of the plurality of second sub-system dock-side sheaves 22*a,b* is longitudinally 11 located between a longitudinally 11 successive pair of second sub-system ship-side sheaves 18*a-c*, wherein a last of the plurality of second sub-system ship-side sheaves 18*a* is longitudinally 11 located after a last of the plurality of second sub-system dock-side sheave 22*a*, and wherein a first of the plurality of second sub-system ship-side sheaves 18*c* is longitudinally 11 located before a first of the plurality of second sub-system dock-side sheaves 22*b*; and providing constant tension to the length of the second mooring line 16 from the first of the plurality of second sub-system ship-side sheaves 18*c* to the last of the second sub-system ship-side sheaves 18*a* by securing a third counterweight 42 to a first end of the second mooring line 16 and securing a fourth counterweight 44 to a second end of the second mooring line 16.

Exemplary Method Embodiments Section 4

With reference to sub-system 70 in FIG. 7, all of the method embodiments described in this Exemplary Method Embodiments Section 4 include the following base permutation (base permutation 4):

disposing a first mooring line 16*a* through a plurality of first sub-system ship-side sheaves 70*h-j* and a plurality of first sub-system dock-side sheaves 70*k-m* such that the first mooring line 16*a* alternatingly runs through a longitudinally 11 successive plurality of the plurality of first sub-system ship-side sheaves 70*h-j* and the first sub-system dock-side sheaves 70*k-m* and the first mooring line 16*a* runs through the last of the plurality of first sub-system ship-side sheaves 70*j* to and through the last of the plurality of first sub-system dock-side sheaves 70*m*, wherein each of the plurality of first sub-system dock-side sheaves 70*k-m* is longitudinally 11 located between a longitudinally 11 successive pair of first sub-system ship-side attachments 70*d-g*, wherein a last of the plurality of first sub-system ship-side sheaves 70*j* is longitudinally 11 located after a last of the plurality of first sub-system dock-side sheaves 70*m*, and wherein a first of the plurality of first sub-system ship-side attachments 70*d* is longitudinally 11 located before a first of the plurality of first sub-system dock-side sheaves 70*k*; and providing constant tension to the length of the first mooring line 16*a* from the first of the plurality of first sub-system ship-side attachment 70*d* to the last of the first sub-system ship-side sheave 70*j* by securing a first end of the first mooring line 16*a* to the first of the a plurality of first sub-system ship-side attachments 70*d* and securing a first counterweight 42 to a second end of the first mooring line 16*a*.

With reference to subsystem 10 in FIG. 1, some of these embodiments further include, i.e., in addition to base permutation 4, disposing a second mooring line 16 through a plurality of second sub-system ship-side sheaves 18*a-c* and a plurality of second sub-system dock-side sheaves 22*a,b* such that the second mooring line 16 alternatingly runs through a longitudinally 11 successive plurality of the plurality of second sub-system ship-side sheaves 18*a-c* and the second sub-system dock-side sheaves 22*a,b* and the second mooring line 16 runs through the last of the plurality of second sub-system dock-side sheaves 22*a* and the last of the plurality of second sub-system ship-side sheaves 18*a*, wherein each of the plurality of second sub-system dock-side sheaves 22*a,b* is longitudinally 11 located between a longitudinally 11 successive pair of second sub-system ship-side sheaves 18*a-c*, wherein a last of the plurality of second sub-system ship-side sheaves 18*a* is longitudinally 11 located after a last of the plurality of second sub-system dock-side sheave 22*a*, and wherein a first of the plurality of second sub-system ship-side sheaves 18*c* is longitudinally 11 located before a first of the plurality of second sub-system dock-side sheaves 22*b*; and providing constant tension to the length of the second mooring line 16 from the first of the plurality of second sub-system ship-side sheaves 18*c* to the last of the second sub-system ship-side sheaves 18*a* by securing a second counterweight 42 to a first end of the second mooring line 16 and securing a third counterweight 44 to a second end of the second mooring line 16.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A mooring system, comprising:

a counterweight;

a plurality of dock-side mooring attachments associated with a pier in a longitudinal series;

a plurality of ship-side mooring attachments associated with a ship in a longitudinal series;

a mooring line;

a plurality of ship sheaves associated with said plurality of ship-side mooring attachments;

a plurality of dock-side sheaves associated with said plurality of dock-side mooring attachments;

at least one of said dock-side sheaves being longitudinally located between a pair of longitudinally successive sheaves of said plurality of ship-side sheaves;

a last of said plurality of dock-side sheaves being longitudinally located behind a last of said plurality of ship-sheaves;

a first of said plurality of dock-side mooring attachments being longitudinally located before a first of said plurality of ship-side sheaves;

said mooring line connected to said first of said plurality of dock-side mooring attachments;

said mooring line alternatingly running through a longitudinally successive plurality of said plurality of dock-side sheaves and said plurality of ship-side sheaves;

said mooring line running through said last of said plurality of ship-side sheaves to said last of said plurality of dock-side sheaves;

said mooring line running through said last of said plurality of dock-side sheaves; and said counterweight being connected to said second end of said mooring line, wherein said counterweight is of sufficient weight to provide constant tension to said mooring line.

2. The system of claim 1, wherein said counterweight weighs about ten tons.

3. The system of claim 1, wherein said line length and said counterweight are of sufficient length and weight respectively to restrain said ship during 100 year extreme events.

4. A mooring system, comprising:

a plurality of counterweights;

a plurality of rear-side sub-system dock-side mooring attachments associated with a pier in a longitudinal series;

a plurality of rear-side sub-system ship-side mooring attachments associated with a ship in a longitudinal series;

a plurality of front-side sub-system dock-side mooring attachments associated with a pier in a longitudinal series;

a plurality of front-side sub-system ship-side mooring attachments associated with a ship in a longitudinal series;

a plurality of mooring lines;

a plurality of rear-side sub-system ship-side sheaves associated with said plurality of rear-side sub-system ship-side mooring attachments;

a plurality of rear-side sub-system dock-side sheaves associated with said plurality of rear-side sub-system dock-side mooring attachments;

a plurality of front-side sub-system ship-side sheaves associated with said plurality of front-side sub-system ship-side mooring attachments;

a plurality of front-side sub-system dock-side sheaves associated with said plurality of rear-side sub-system dock-side mooring attachments;

at least one of said plurality of rear-side sub-system dock-side sheaves being longitudinally located between a pair of longitudinally successive sheaves of said plurality of rear-side sub-system ship-side sheaves;

at least one of said plurality of front-side sub-system dock-side sheaves being longitudinally located between a pair of longitudinally successive sheaves of said plurality of front-side sub-system ship-side sheaves;

a last of said plurality of rear-side sub-system dock-side sheaves being longitudinally located behind a last of said plurality of ship-sheaves;

a first of said plurality of rear-side sub-system dock-side attachments being longitudinally located behind a first of said plurality of ship-side sheaves;

a first end of a first of said plurality of mooring, lines connected to said first of said plurality of rear-side sub-system dock-side attachments;

said first of said plurality of mooring lines connected to said first of said plurality of rear-side sub-system dock-side mooring ring attachments;

said first of said plurality of mooring lines alter running through a longitudinally successive plurality of said plurality of rear-side sub-system dock-side sheaves and said plurality of rear-side sub-system ship-side sheaves; and said first of said plurality of mooring lines running through said last of said plurality of rear-side sub-system ship-side sheaves to said last of said plurality of rear-side sub-system dock-side sheaves; said first of said plurality of mooring lines running through said last of said plurality of rear-side sub-system dock-side sheaves;

a first of said plurality of counterweights being connected to a second end of said first of said plurality of mooring lines; said first of said plurality of counterweights being of sufficient weight to provide constant tension throughout the length of said first of said plurality of mooring lines from said first of said plurality of rear-side sub-system dock-side attachments to said last of said plurality of front-side sub-system dock-side sheaves;

a plurality of front-side sub-system ship-side sheaves associated with said plurality of front-side sub-system ship-side mooring attachments;

a plurality of front-side sub-system dock-side sheaves associated with said plurality of front-side sub-system dock-side mooring attachments;

at least one of said plurality of front-side sub-system dock-side sheaves being longitudinally located between a pair of longitudinally successive plurality affront-side sub-system ship-side sheaves;

at least one of said plurality of front-side sub-system dock-side sheaves being longitudinally located between a pair of longitudinally successive plurality of front-side sub-system ship-side sheaves;

a last of said plurality of front-side sub-system dock-side sheaves being longitudinally located behind a last of said plurality of ship-sheaves;

a first of said plurality of front-side sub-system dock-side attachments being longitudinally located before a first of said plurality of ship-side sheaves;

a first end of a second of said plurality of mooring lines connected to said first of said plurality of front-side sub-system dock-side attachments;

said second of said plurality of mooring lines connected to said first of said plurality of front-side sub-system dock-side mooring attachments;

said second of said plurality of mooring lines alternatingly running through a longitudinally successive plurality of said plurality of front-side sub-system dock-side sheaves and said plurality of front-side sub-system ship-side sheaves;

said second of said plurality of mooring lines running through said last of said plurality of front-side sub-system ship-side sheaves to said last of said plurality of front-side sub-system dock-side sheaves; said second of said plurality of mooring lines running through said last of said plurality of front-side sub-system dock-side sheaves; and a second of said plurality of counterweights being connected to a second end of said second of said plurality of mooring lines; said counterweight being of sufficient weight to provide constant tension throughout the length of said second of said plurality of mooring lines from said first of said plurality of front-side sub-system dock-side attachments to said last of said plurality of front-side sub-system dock-side sheaves.

5. The system of claim 4, wherein each of said first and second of said plurality of counterweight weighs about ten tons.

6. The system of claim 4, wherein said line length, and said first and second of said plurality of counterweights, are of sufficient length and weight respectively to restrain said ship during 100 year extreme events.

7. A mooring system, comprising:

a plurality of counterweights;

a plurality of dock-side mooring attachments associated with a pier in a longitudinal series;

a plurality of ship-side mooring attachments associated with a ship in a longitudinal series;

a mooring line;

a plurality of ship-side sheaves associated with said plurality of ship-side mooring attachments;

a plurality of dock-side sheaves associated with said plurality of dock-side mooring attachments;

at least one of said plurality of dock-side sheaves being longitudinally located between a pair of longitudinally successive ship-side sheaves;

a last of said plurality of dock-side sheaves being longitudinally located behind a last of said plurality of ship-sheaves;

a first of said plurality of dock-side sheaves being longitudinally located before a first of said plurality of ship-side sheaves;

a first end of said mooring line connected to a first of said plurality of counterweights;

a second end of said mooring line connected to a first of said plurality of counterweights;

said mooring line running through said first of said plurality of dock-side sheaves;

said mooring, line alternatingly running through a longitudinally successive plurality of said plurality of dock-side sheaves and said plurality of ship-side sheaves; and said mooring line running through said last of said plurality of ship-side sheaves and said last of said plurality of dock-side sheaves; and said counterweight being of sufficient weight to provide constant tension to the length of said mooring line from said first of said plurality of dock-side sheaves to said last of said plurality of dock-side sheaves.

8. The system of claim 7, wherein each of said first and second of said plurality of counterweight weighs about ten tons.

9. The system of claim 8, wherein said line length, and said first and second of said plurality of counterweights, are of sufficient length and weight respectively to restrain said ship during 100 year extreme events.

10. A mooring system, comprising:

a plurality of counterweights;

a plurality of dock-side mooring attachments associated with a pier in a longitudinal series;

a plurality of ship-side mooring attachments associated with a ship in a longitudinal series;

a mooring line;

a plurality of ship-side sheaves associated with said plurality of ship-side mooring attachments;

a plurality of dock-side sheaves associated with said plurality of dock-side mooring attachments;

at least one of said plurality of dock-side sheaves being longitudinally located between pair of longitudinally successive ship-side sheaves;

a last of said plurality of ship-side sheaves being longitudinally located behind a last of said plurality of dock-side sheaves;

a first end of said plurality of ship-side sheaves being longitudinally located before a first of said plurality of dock-side sheaves;

a first end of said mooring, line connected to a first of said plurality of counterweights;

a second end of said mooring line connected to a second of said plurality of counterweights;

said mooring line running through said first of said plurality of ship-side sheaves;

said mooring line alternatingly running through a longitudinally successive plurality of said plurality of dock-side sheaves and said plurality of ship-side sheaves;

said mooring line running through said last of said plurality of ship-side sheaves and said last of said plurality of dock-side sheaves; and said first and second of said plurality of counterweights being of sufficient weight to provide constant tension to the length of said mooring line from said first of said plurality of ship-side sheaves to said last of said plurality of ship-side sheaves.

11. The system of claim 10, wherein each of said first and second of said plurality of counterweight weighs about ten tons.

12. The system of claim 10, wherein said line length, and said first and second of said plurality of counterweights, are of sufficient length and weight respectively to restrain said ship during 100 year extreme events.

13. A mooring system comprising:

a plurality of counterweights;

a plurality of rear-side sub-system dock-side mooring attachments associated with a pier in a longitudinal series;

a plurality of rear-side sub-system ship-side mooring attachments associated with a ship in a longitudinal series;

a plurality of front-side sub-system dock-side mooring attachments associated with a pier in a longitudinal series;

a plurality of front-side sub-system ship-side mooring attachments associated with a ship in a longitudinal series;

a plurality of mooring lines;

a plurality of rear-side sub-system ship-side sheaves associated with said plurality of rear-side sub-system ship-side mooring attachments;

a plurality of rear-side sub-system dock-side sheaves associated with said plurality of rear-side sub-system dock-side mooring attachments;

a plurality of front-side sub-system ship-side sheaves associated with said plurality of front-side sub-system ship-side mooring attachments;

a plurality of front-side sub-system dock-side sheaves associated with said plurality of front-side sub-system dock-side mooring attachments;

at least one of said plurality of rear-side sub-system dock-side sheaves being longitudinally located between a pair of longitudinally successive plurality of rear-side sub-system ship-side sheaves;

at least one of said plurality of front-side sub-system dock-side sheaves being longitudinally located between a pair of longitudinally successive plurality of front-side sub-system ship-side sheaves;

a last of said plurality of rear-side sub-system dock-side sheaves being, longitudinally located behind a last of said plurality of rear-side sub-system ship-side sheaves;

a first of said plurality of rear-side sub-system dock-side attachments being longitudinally located before a first of said plurality of rear-side sub-system ship-side sheaves;

a first end of a first of said plurality of mooring lines connected to said first of said plurality of rear-side sub-system dock-side attachments;

said first of said plurality of mooring lines connected to said first of said plurality of rear-side sub-system dock-side mooring attachments;

said first of said plurality of mooring lines alternatingly running through a longitudinally successive plurality of said plurality of rear-side sub-system dock-side sheaves and said plurality of rear-side sub-system ship-side sheaves; and said first of said plurality of mooring lines running through said last of said plurality of rear-side sub-system ship-side sheaves to said last of said plurality of rear-side sub-system dock-side sheaves; said first of said plurality of mooring lines running, through said last of said plurality of rear-side sub-system dock-side sheaves;

a first of said plurality of counterweights being connected to a second end of said first of said plurality of mooring lines; said first of said plurality of counterweights being of sufficient weight to provide constant tension throughout the length of said first of said plurality of mooring lines from said first of said plurality of rear-side sub-system dock-side attachments to said last of said plurality of front-side sub-system dock-side sheaves;

a plurality of front-side sub-system ship-side sheaves associated with said plurality of front-side sub-system ship-side mooring attachments;

a plurality of front-side sub-system dock-side sheaves associated with said plurality of front-side sub-system dock-side mooring attachments;

at least one of said plurality of front-side sub-system dock-side sheaves being longitudinally located between a pair of longitudinally successive plurality of front-side sub-system ship-side sheaves;

at least one of said plurality of front-side sub-system dock-side sheaves being longitudinally located between a pair of longitudinally successive plurality of front-side sub-system ship-side sheaves;

a last of said plurality of front-side sub-system dock-side sheaves being longitudinally located behind a last of said plurality of ship-sheaves;

a first of said plurality of front-side sub-system dock-side attachments being longitudinally located before a first of said plurality of ship-side sheaves;

a first end of a second of said plurality of mooring lines connected to said first of said plurality of front-side sub-system dock-side attachments;

said second of said plurality of mooring lines connected to said first of said plurality of front-side sub-system dock-side mooring attachments;

said second of said plurality of mooring lines alternatingly running through a longitudinally successive plurality of said plurality of front-side sub-system dock-side sheaves and said plurality of front-side sub-system ship-side sheaves;

said second of said plurality of mooring lines running through said last of said plurality of front-side sub-system ship-side sheaves to said last of said plurality of front-side sub-system dock-side sheaves: said second of said plurality of mooring lines running through said last of said plurality of front-side sub-system dock-side sheaves; and a second of said plurality of counterweights being connected to a second end of said second of said plurality of mooring lines; said counterweight being of sufficient weight to provide constant tension throughout the length of said second of said plurality of mooring lines from said first of said plurality of front-side sub-system dock-side attachments to said last of said plurality of front-side sub-system dock-side sheaves.

14. The system of claim 13, wherein each of said first and second of said plurality of counterweight weighs about ten tons.

15. The system of claim 13, wherein said first and second mooring line, said first and second of said plurality of counterweights, said front-side sub-system dock-side attachments, front-side sub-system ship-side attachments, front-side sub-system dock-side sheaves and front-side sub-system ship-side sheaves, said rear-side sub-system dock-side attachments, rear-side sub-system ship-side attachments, rear-side sub-system dock-side sheaves and rear-side sub-system ship-side sheaves, are of sufficient length, weight, and strength, respectively to restrain said ship during 100 year extreme events.

16. A mooring system, comprising:

counterweight;

a plurality of dock-side mooring attachments associated with a pier in a longitudinal series;

a plurality of ship-side mooring attachments associated with a ship in a longitudinal series;

a mooring line;

a plurality of ship sheaves associated with said plurality of ship-side mooring attachments;

a plurality of dock-side sheaves associated with said plurality of dock-side mooring attachments;

at least one of said dock-side sheaves being longitudinally located between a pair of longitudinally successive ship-side sheaves;

a last of said plurality of ship-side sheaves being longitudinally located behind a last of said plurality of dock-side sheaves;

a first of said plurality of ship-side mooring attachments being longitudinally located before a first of said plurality of dock-side sheaves;

said mooring line connected to said first of said plurality of ship-side mooring attachments;

said mooring line alternatingly running through a longitudinally successive plurality of said plurality of dock-side sheaves and said plurality of ship-side sheaves; and said mooring line running through said last of said plurality of dock-side sheaves to said last of said plurality of ship-side sheaves; said mooring line running through said last of said plurality of dock-side sheaves; and said counterweight being connected to said second end of said mooring line; said counterweight being of sufficient weight to provide constant tension to said mooring line.

17. The system of claim 16, wherein said counterweight weighs about ten tons.

18. The system of claim 16, wherein said line length, and said counterweight, are of sufficient length and weight respectively to cooperate with the remainder of said system to restrain said ship during 100 year extreme events.

* * * * *